US008132958B2

(12) United States Patent
Renfro

(10) Patent No.: US 8,132,958 B2
(45) Date of Patent: Mar. 13, 2012

(54) MULTI-CHAMBERED FLUID MIXING APPARATUS AND METHOD

(76) Inventor: Charles K. Renfro, Elizabethton, TN (US)

( * ) Notice: Subject to any disclaimer, the term of this patent is extended or adjusted under 35 U.S.C. 154(b) by 1065 days.

(21) Appl. No.: 11/955,321

(22) Filed: Dec. 12, 2007

(65) Prior Publication Data

US 2008/0144433 A1 Jun. 19, 2008

Related U.S. Application Data

(60) Provisional application No. 60/874,785, filed on Dec. 13, 2006.

(51) Int. Cl.
*B01F 15/02* (2006.01)
*B65D 25/08* (2006.01)

(52) U.S. Cl. ..... 366/130; 366/162.3; 206/222

(58) Field of Classification Search ..... 366/130, 366/162.3; 206/222
See application file for complete search history.

(56) References Cited

U.S. PATENT DOCUMENTS 2,752,036 A * 6/1956 Parkhurst, Jr. ..... 206/222
3,039,644 A * 6/1962 Lefcort ..... 220/501
3,217,946 A * 11/1965 Cook ..... 222/386
3,347,410 A * 10/1967 Schwartzman ..... 222/80
3,370,754 A * 2/1968 Schumann et al. ..... 222/132
3,438,549 A * 4/1969 Ritz ..... 222/83.5
3,596,801 A * 8/1971 Barnack ..... 222/81
4,007,233 A 2/1977 Kako et al.
4,089,437 A * 5/1978 Chutter et al. ..... 222/94
4,177,938 A * 12/1979 Brina ..... 222/80
4,325,368 A * 4/1982 Kaemmerer ..... 604/80
4,396,383 A * 8/1983 Hart ..... 604/518
4,548,606 A * 10/1985 Larkin ..... 604/414
4,648,532 A * 3/1987 Green ..... 222/82
4,776,704 A * 10/1988 Kopunek et al. ..... 366/184
4,808,006 A * 2/1989 Kaufeler ..... 366/332
4,961,516 A * 10/1990 Nakamura ..... 222/94
5,174,475 A * 12/1992 Day et al. ..... 222/144.5
5,333,737 A 8/1994 Clark
5,426,148 A 6/1995 Tucker
5,549,380 A * 8/1996 Lidgren et al. ..... 366/139
5,551,778 A * 9/1996 Hauke et al. ..... 366/139
6,520,335 B2 2/2003 Moran et al.
6,910,799 B2 6/2005 Renfro
7,070,318 B2 7/2006 Renfro
2007/0177455 A1 8/2007 Renfro

* cited by examiner

*Primary Examiner* — Tony G Soohoo
(74) *Attorney, Agent, or Firm* — Luedeka Neely Group, P.C.

(57) ABSTRACT

A method and apparatus for substantially simultaneously mixing two fluids to form a mixture for application to a substrate.

23 Claims, 6 Drawing Sheets

MULTI-CHAMBERED FLUID MIXING APPARATUS AND METHOD

CROSS REFERENCE TO RELATED APPLICATION

This is a non-provisional application claiming benefit of U.S. Provisional Application Ser. No. 60/874,785 filed Dec. 13, 2006, and entitled "Inject-A-Color" Custom Coloring Of Caulk In Off-The-Shelf Cartridge Or Tube, incorporated herein by reference in its entirety.

FIELD

This invention relates to the field of multi-chambered fluid mixing devices and methods for using such devices.

BACKGROUND

Various fluid mixing devices and methods for using such devices have been developed for mixing two or more fluids. One such device, described in U.S. Pat. No. 6,910,799, incorporated herein by reference in its entirety, involves mixing a viscous caulking compound with colorant using a mixer shaft that is reciprocated for mixing. Another related U.S. Pat. No. 7,070,318, incorporated herein by reference in its entirety, also involves mixing a viscous caulking compound with colorant using a rotatable mixer shaft that is rotated and reciprocated for mixing. However, these techniques require at least the reciprocation of a mixing shaft having a blade to accomplish the mixing.

Many other types of applications require the mixing of two or more fluids to accomplish the formation of a desired mixture such as the mixing of two fluids to form epoxy (e.g., as described in U.S. Pat. No. 5,333,737, incorporated herein by reference in its entirety), the mixing of two fluids to form rubber cement (e.g., as described in U.S. Pat. No. 4,007,233, incorporated herein by reference in its entirety), and the mixing of two or more fluids to form a polymeric sealant (e.g., as described in U.S. Pat. No. 5,426,148, incorporated herein by reference in its entirety). U.S. Pat. No. 6,520,335, incorporated herein by reference in its entirety, more broadly describes a method and a container for mixing multi-component polymer coatings and adhesives using two or more sealed pouches in a mixing container.

None of these references briefly discussed above describe a simple apparatus or method for mixing two or more fluids in an apparatus that requires no reciprocating or rotating mixing action and whereby the mixture may be accurately dispensed substantially while mixing is taking place.

What is needed, therefore, is a simple mixing apparatus that requires no back and forth reciprocating motion and no rotating motion to accomplish the mixing of two or more fluids. What is also needed is a simple mixing apparatus that is capable of accurately dispensing a mixture substantially while two or more fluids are being mixed in the apparatus to form the mixture.

SUMMARY

The above and other needs are met by a mixing apparatus, preferably handheld, configured for mixing two or more fluid substances substantially simultaneously without the need for reciprocal mixing motion, axial mixing motion, or moving parts within the mixing chamber. Some of the preferred embodiments are described further below.

A preferred embodiment includes an apparatus for mixing two or more fluid substances. The apparatus includes an elongate primary chamber configured for containing a first substance, the primary chamber including a primary chamber dispensing end and a primary chamber non-dispensing end; an elongate secondary chamber substantially aligned longitudinally with and attached to the primary chamber, the secondary chamber configured for containing a second substance, the secondary chamber including a secondary chamber dispensing end and a secondary chamber non-dispensing end wherein the secondary non-dispensing end is proximate the primary chamber dispensing end; a movable back plug configured for longitudinal movement along the primary chamber, wherein such longitudinal movement toward the primary chamber dispensing end causes at least a portion of the first substance to exit through the primary chamber dispensing end and at least a portion of the second substance to exit through the primary chamber dispensing end; and a removable dispensing tip attached to the primary chamber dispensing end, the removable dispensing tip including a mixing chamber that, when the back plug is moved toward the primary chamber dispensing end, causes substantial mixing of the first substance with the second substance.

The first chamber is preferably shaped substantially similarly to a caulk tube so that a caulking gun or other similar device may be used along with certain embodiments of the invention. In a preferred embodiment, the first substance preferably includes caulk and the second substance preferably includes colorant as defined herein.

In a related embodiment, the apparatus includes an elongate primary chamber including a tube, the tube containing a first substance, the primary chamber including a primary chamber dispensing end and a primary chamber non-dispensing end; an elongate secondary chamber substantially aligned with and attached to the primary chamber, the secondary chamber including a non-rigid bladder configured for containing a second substance, the secondary chamber including a secondary chamber dispensing end and a secondary chamber non-dispensing end; a back plug configured for longitudinal movement along the primary chamber, wherein such longitudinal movement toward the primary chamber dispensing end displaces at least a portion of the first substance out of the primary chamber and at least a portion of a second substance out of the primary chamber; an engagement member attached to the primary chamber at a location along the dispensing end of the primary chamber; a dispensing tip removably attachable to the engagement member, the dispensing tip including a mixing chamber that, substantially when the back plug is moved toward the primary chamber dispensing end, causes substantial mixing of the first substance from the primary chamber with a second substance from the secondary chamber; a fill port located along the outer surface of the primary chamber, the fill port configured for fluid communication through the fill port to the secondary chamber such that the secondary chamber may be filled with a second substance by insertion of a second substance through the fill port; and a barrier structure configured for substantially obstructing fluid communication between the fill port and the secondary chamber.

In another aspect, the embodiments of the invention provide methods for mixing two or more fluid substances. A preferred embodiment of such a method includes the step of providing a mixing apparatus including an elongate primary fluid storage zone having been pre-filled with a first substance; an elongate secondary fluid storage zone longitudinally aligned with the primary fluid storage zone for storing a second substance; a mixing zone; and a separation barrier obstructing the first substance and the second substance from entering the mixing zone. The method further includes the steps of inserting a second substance into the secondary fluid storage zone; breaching the separation barrier; and forcing the first substance and the second substance, substantially simultaneously, to the mixing zone.

BRIEF DESCRIPTION OF THE DRAWINGS

Further advantages of the invention are apparent by reference to the detailed description in conjunction with the figures, wherein elements are not to scale so as to more clearly show the details, wherein like reference numbers indicate like elements throughout the several views, and wherein.

DETAILED DESCRIPTION

Figure 1:
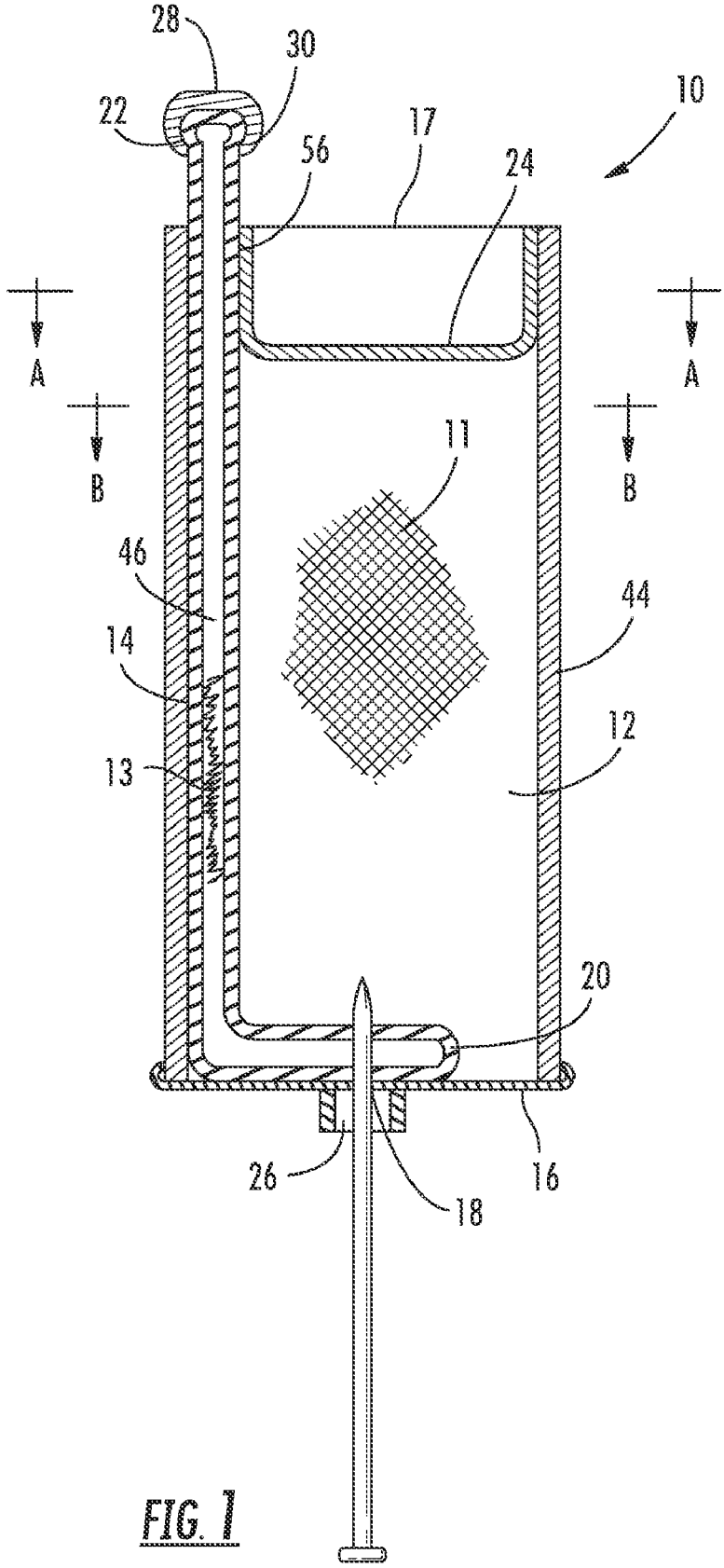
FIG. 1 depicts a cross-sectional view of a multi-chambered mixing apparatus including a fill port located proximate a primary chamber non-dispensing end.

FIG. 1 depicts a preferred embodiment of a mixing apparatus 10 for mixing two or more fluids as described herein. The term "fluid" is broadly defined to include, but not be limited to, liquids, colloids, suspensions, slurries, plastic solids, and combinations thereof. The apparatus 10 resembles caulk tube and preferably has substantially the same dimensions as a caulk tube so that a caulking gun may be used along with the mixing apparatus 10. The apparatus 10 further includes a primary chamber 12 capable of holding a first substance such as first substance 11 and a secondary chamber 14 capable of holding a second substance such as second substance 13. The primary chamber further includes a primary chamber dispensing end 16, a primary chamber non-dispensing end 17, and, in certain embodiments, a first aperture 18 located along the primary chamber dispensing end 16. The secondary chamber further includes a secondary chamber dispensing end 20 and a secondary chamber non-dispensing end 22. The apparatus also includes a back plug 24 and an engagement member 26. A fill port 28 is located along the secondary chamber non-dispensing end 22 and a barrier structure 30 is associated with the fill port 28.

Figure 2:
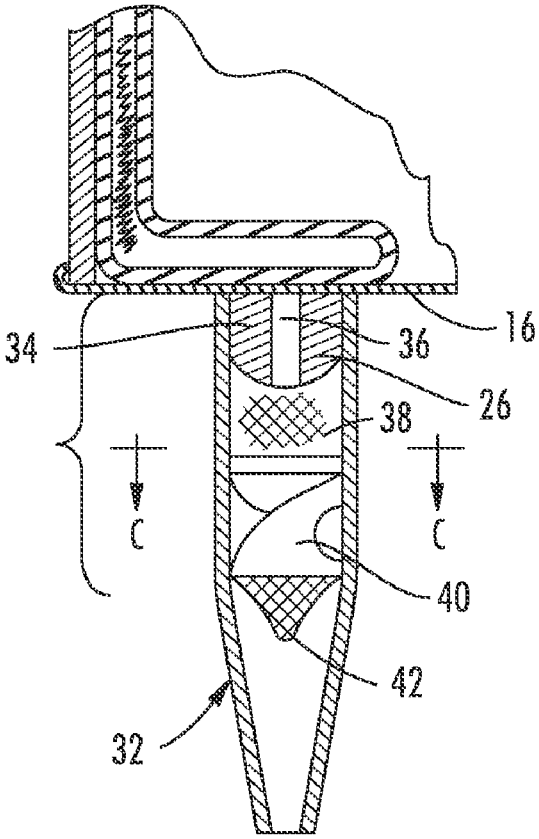
FIG. 2 depicts a lower portion of the multi-chambered mixing apparatus shown in FIG. 1 and further showing a dispensing tip attached to the mixing apparatus.
Figure 3:
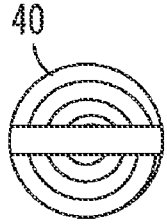
FIG. 3 depicts a top view of the helical mixer segment taken along line C-C in FIG. 2.
Figure 8:
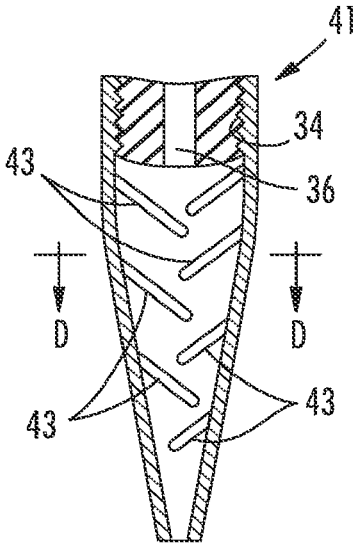
FIG. 8 depicts a cross-sectional view of an alternate embodiment the dispensing tip shown in FIG. 2.
Figure 9:
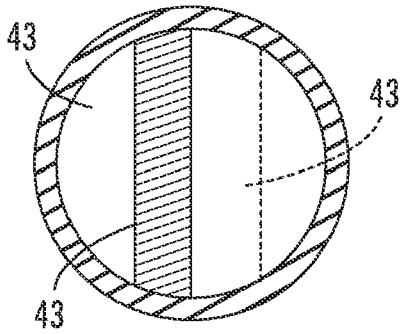
FIG. 9 depicts a cross-sectional view taken along line D-D in FIG. 8.

FIG. 2 shows a cross sectional view near the primary chamber dispensing end 16 in which a dispensing tip 32 has been attached to the engagement member 26. Although the dispensing tip 32 is attached to the engagement member 26 via threads 34 located along the outer surface of the engagement member 26, other attachment techniques known to persons having ordinary skill in the art may be used in related embodiments of the invention. A fluid channel 36 is located along engagement member 26 for the passage of fluid from the apparatus 10 to the dispensing tip 32. In the embodiment shown in FIG. 2, the dispensing tip 32 further includes a mesh mixing section 38, a substantially helical mixing section 40, and an air pocket reducing section 42. A top view (cut along line "C" in FIG. 2) of the helical mixing section 40 is shown in FIG. 3. In related embodiments, the dispensing tip 32 may include only a mesh mixing section or, alternatively, only a helical mixing section. Additionally, an air pocket reducing section may be absent from other related embodiments of the invention. The mesh mixing section 38 preferably includes mesh material similar to or substantially like steel wool. The mesh material may be made of metal, plastic, rubber, other polymeric materials known to persons having ordinary skill in the art, or a combination thereof. In a related embodiment, a dispensing tip 41 may include a plurality of baffles 43 as shown in FIG. 8 and FIG. 9. The baffles 43 may vary in shape and could be, for example, curved, helical, flat, any similar shape known to persons having ordinary skill in the art, or a combination thereof. FIG. 9 is a top view cut a line "D" in FIG. 8.

Figure 14:
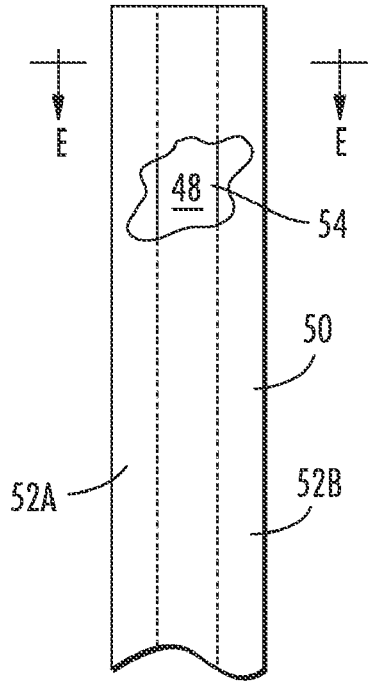
FIG. 14 depicts a side view of bladder configured for holding a second substance.
Figure 15:
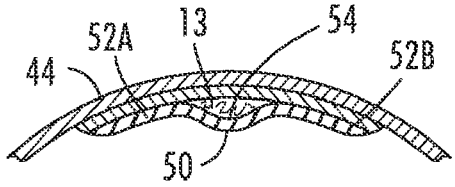
FIG. 15 depicts a cross-sectional view taken along line E-E in FIG. 14.

In the embodiment shown in FIG. 1 and FIG. 2, the primary chamber preferably includes an elongate rigid tube 44 made from polymeric material and/or metal having a thickness similar to the thickness of a standard tube of caulk. The secondary chamber preferably includes an elongate non-rigid bladder 46 made from materials such as polyethylene (most preferably ranging from about 1 mil to about 8 mil), polypropylene (most preferably ranging from about 1 mil to about 8 mil), or other similar material known to persons having ordinary skill in the art. The bladder 44 is preferably attached to the interior surface of the tube 44 using one or more adhesives such that the secondary chamber non-dispensing end 22 substantially covers the first aperture 18, substantially preventing any fluid from exiting from the primary chamber 12 through the first aperture 18. In a preferred embodiment shown in FIG. 14 and FIG. 15, the bladder 44 is preferably includes a first bladder layer 48 and a second bladder layer 50. FIG. 15 is a top view cut from line "D" in FIG. 14. The first bladder layer 48 is attached to at least the inner longitudinal surface of the primary chamber 12, preferably by one or more adhesives. The second bladder layer 50 is attached to the first bladder layer 48 along edge area 52A and 52B, thereby forming a void 54 between the first bladder layer 48 and the second bladder layer 50. In this embodiment, if the secondary chamber is filled with fluid, the fluid resides within the void 54 and is kept substantially separated from (i.e., out of fluid communication with) any content in the primary chamber 12.

The fill port 28 allows for the bladder 46 to be filled with a fluid such as the second substance 15. In a preferred embodiment, the upper end 48 of the secondary chamber 14 is preferably semi-rigid, thereby making it easier to insert fluid into the secondary chamber 14 to a location 54 along the bladder 46 beyond where the back plug 24 is in direct contact with the bladder 46. In a related embodiment, the back plug 24 includes a groove 50 oriented in substantial alignment with and substantially conforming to the bladder 46, thereby making it easier to insert fluid into the secondary chamber 14 to about location 48.

Figure 4:
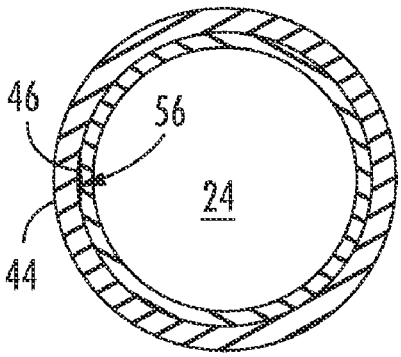
FIG. 4 depicts a cross-sectional view taken along line A-A in FIG. 1 showing the configuration of the apparatus at line A-A including a primary chamber, a secondary chamber, and a back plug.
Figure 5:
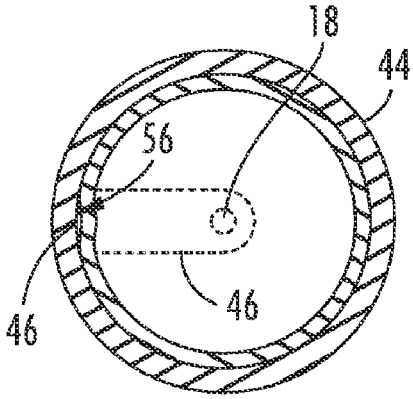
FIG. 5 is a cross-sectional view taken along line B-B in FIG. 1 showing the configuration of the apparatus at line A-A including a primary chamber, a secondary chamber, and a back plug.
Figure 7:
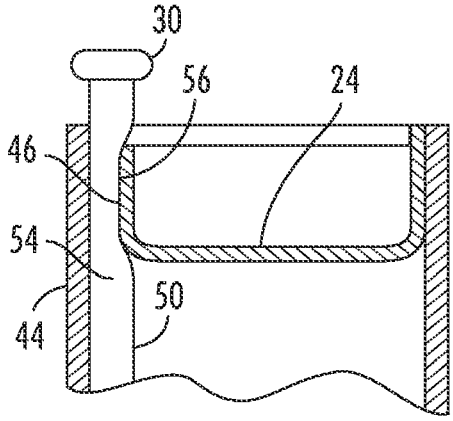
FIG. 7 depicts a cross-sectional view of the upper portion of the embodiment of the mixing apparatus shown in FIG. 1 showing the back plug moved slightly toward the dispensing end of the mixing apparatus.

Because the tube 44 and the back plug 24 are substantially rigid and the bladder 46 is substantially non-rigid, the back plug edge 56 squeezes the bladder 46 in the area where the back plug edge 56 is in contact with the bladder 46. This effect is demonstrated by comparing FIG. 4, a top view cut along line "A" in FIG. 1 where the bladder 46 is being squeezed by the back plug 24, and FIG. 5, a top view cut along line "B" in FIG. 1 where the portion of the bladder 46 that is shown is not in direct contact with the back plug 24. FIG. 7 also gives a cross sectional perspective of the influence of the back plug 24 on the bladder 46.

Figure 10:
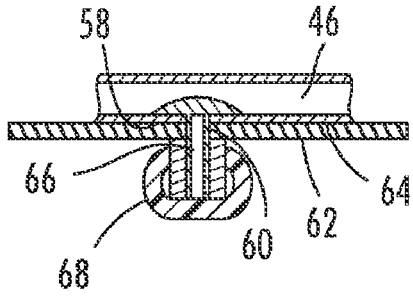
FIG. 10 depicts a snap-in grommet including a removeable barrier structure attached thereto located along a fill port along the primary chamber surface.
Figure 11:
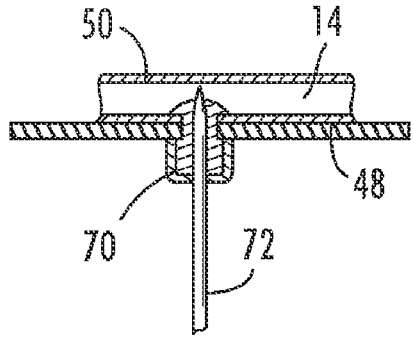
FIG. 11 depicts a self-sealing stopper for a fill port wherein a needle type syringe may be employed to insert a second substance into the secondary chamber.

Barrier structure 30 as shown with the embodiment displayed in FIG. 1 and FIG. 7 is a removable plastic cap that allows the secondary chamber non-dispensing end 22 to be substantially sealed and resealed. In certain embodiments, barrier structure 30 may include a grommet to reinforce the fill port 28. Also, in various embodiments, the cap may be attached by different attachment structures such as by snapping, screwing, or other fastening techniques known to person having ordinary skill in the art. In related embodiments, the barrier structure 30 may include self-sealing stopper, preferably made of an elastomeric material. Such a stopper could be used, for example, as an insertion and removal point for a hollow needle used with a syringe to fill or refill the secondary chamber with a fluid. FIG. 10 shows a snap in type grommet 58 which has been inserted through an aperture 60 made through a primary chamber wall 62 and a secondary chamber wall 64. The grommet includes a canal 66 that operates as a fill port for inserting fluid into the secondary chamber 14. FIG. 10 also shows, for example, a cap 68 for substantially resealing the grommet 58. FIG. 11 shows a similar embodiment including a snap in type grommet 70 having substantially no continuous canal, the grommet 70 being made of a self-sealing material allows for a hollow needle 72 to be inserted through the grommet and into the secondary chamber 14. Thus, a syringe may be used to insert a specifically calculated volume of fluid into the secondary chamber 14. Substantially when the needle 72 is removed, the grommet 70 substantially reseals itself.

Figure 6:
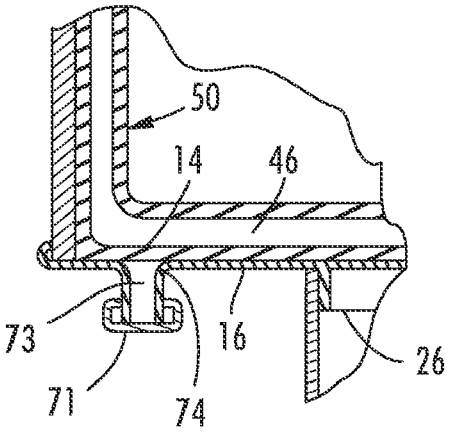
FIG. 6 depicts a cross-sectional view of an alternate embodiment of the mixing apparatus in which the fill port is located along a primary chamber dispensing end.
Figure 16:
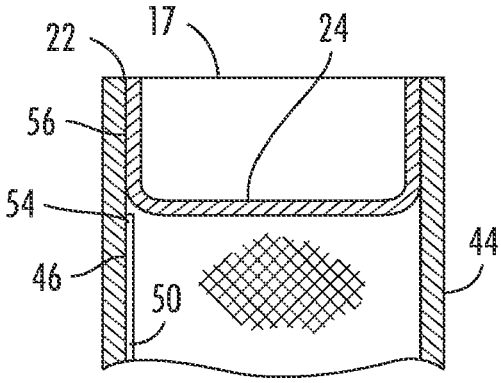
FIG. 16 depicts a cross-sectional view of the top portion of a mixing apparatus in which the mixing apparatus has no fill port (i.e., a pre-filled embodiment in which the primary chamber and the secondary chamber were both at least partially pre-filled with a first substance and a second substance, respectively), the fill port is not located along the primary chamber non-dispensing end, or the upper portion of the secondary chamber that protruded above the primary chamber non-dispensing end (e.g., FIG. 1 and FIG. 7) has been removed (e.g., by cutting).
Figure 17:
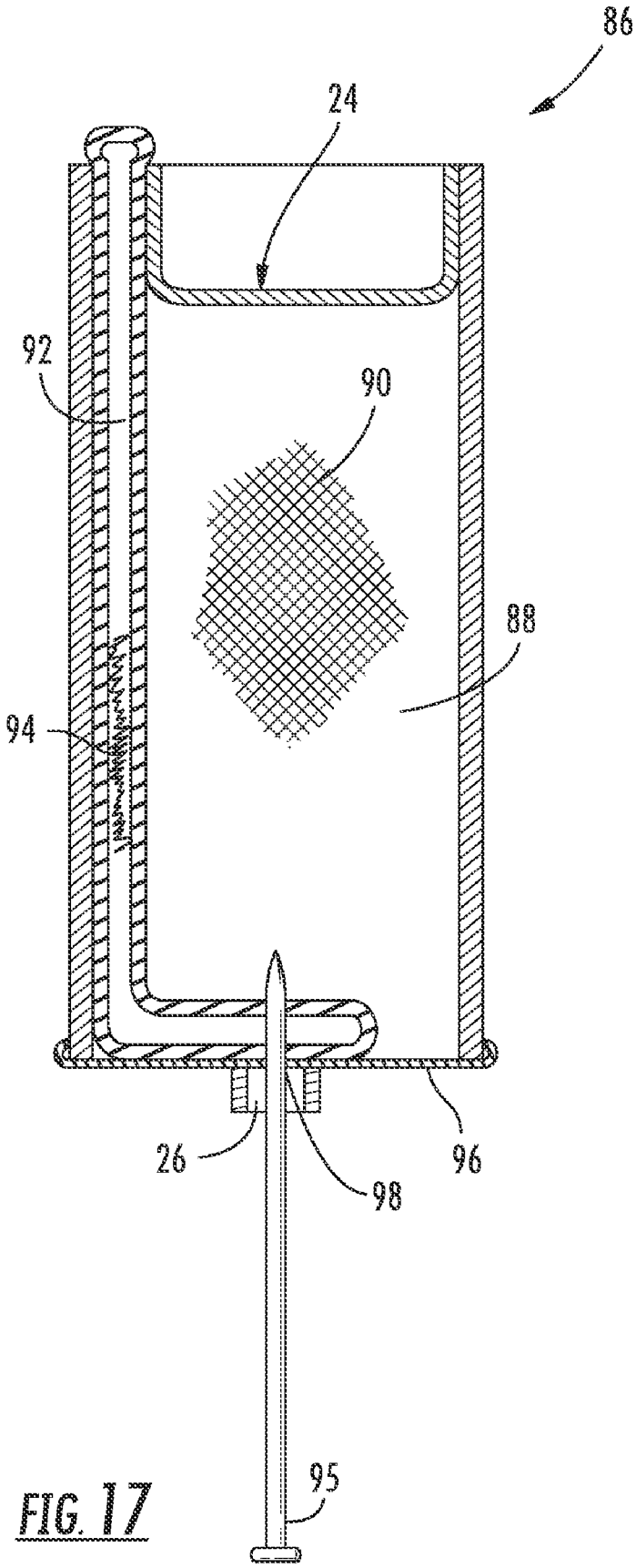
FIG. 17 depicts a cross-sectional view of an embodiment of a mixing device described herein including no fill ports (i.e., a pre-filled embodiment).

FIG. 6 shows an alternative embodiment in which a fill port 74 is located at a different location than the location shown on the embodiment in FIG. 1. Fill port 74 is located along the primary chamber dispensing end 16 and the fill port 74 is preferably in fluid communication with the secondary chamber 14, and secondary chamber 14 is kept substantially sealed by barrier structure 71. In a related embodiment, bladder 46 must be breached via channel 73 to put fill port 74 in fluid communication with the secondary chamber 14. FIG. 16 shows what the primary chamber non-dispensing end 17, the secondary chamber non-dispensing end 22, and the back plug 24 would look like in this particular embodiment. In related embodiments, a fill port may be located substantially anywhere along the outside surface of the primary chamber 12 as long as the location allows for such a fill port to be in fluid communication with the secondary chamber 14 but not in fluid communication with the primary chamber 12. No matter where a fill port is located along the primary chamber 12, a barrier structure similar to barrier structure 30 is preferably associated with such fill port to reseal the fill port after fluid has been inserted into the secondary chamber 14.

Figure 12:
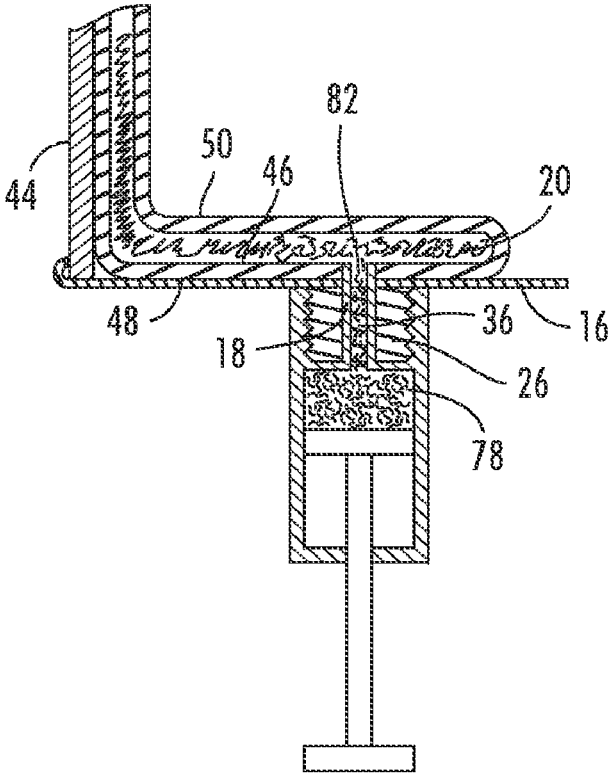
FIG. 12 depicts a cross-sectional view of the primary chamber dispensing end in which the fill port is located along the same aperture in which fluid is to be dispensed from the mixing apparatus including a specialized syringe for inserting a second substance into the secondary chamber.
Figure 13:
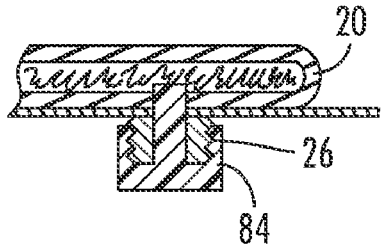
FIG. 13 depicts a cross-sectional view of the primary chamber dispensing end in which the fill port is located along the same aperture in which fluid is to be dispensed from the mixing apparatus including a barrier structure.

In yet another embodiment shown in FIG. 12 and FIG. 13, the first aperture 18 and/or fluid canal 36 operate act as a fill port 76. In a preferred embodiment, a special syringe 78, made to substantially sealingly attach (e.g., as by threads 80) to the engagement member 26 may be used to insert fluid into the secondary chamber through fill port 76. In the embodiment shown in FIG. 12, the secondary chamber 14 includes an aperture 82 such that fluid may enter the secondary chamber 14. The aperture 82 may be made, for example, by puncturing, using a sharp instrument (e.g., a nail) through the fluid channel 36 and, in some embodiments, through the primary chamber dispensing end 16 if no aperture 18 is originally present. FIG. 13 shows an example of a barrier structure 84 (e.g., a threaded cap) that may be fastened to the engagement member 26 to prevent inserted fluid from escaping from the secondary chamber 14 out of the first aperture 18 and the fluid channel 36.

In yet another embodiment substantially similar to the embodiment shown in FIG. 1, a mixing apparatus 86 includes a primary chamber 88 pre-filled with a first substance 90, a secondary chamber 92 pre-filled with a second substance 94, a back plug 24, and an engagement member 26. The primary chamber 88 includes a dispensing end 96. The apparatus may be breached (e.g., punctured) using a nail (e.g., nail 95) or the like to form an aperture 98 through the primary chamber dispensing end 96 and further breaching the secondary chamber such that the first substance 90 and the second substance 94 may exit through aperture 98. In a related embodiment, the secondary chamber substantially covers a pre-formed aperture 98 at the primary chamber dispensing end 96, obstructing fluid flow from the primary chamber 88. In this embodiment, the secondary chamber 92 may be breached via the aperture 98 by using a breaching tool capable of fitting through the aperture 98.

Although the apparatus 10 shown in FIG. 1 is shown to contain a first substance 13 and a second substance 15, persons having ordinary skill in the art appreciate that other embodiments of the apparatus 10 may initially be substantially void of any substances for mixing. In a preferred embodiment, the first substance (13, 90) comprises caulk and the second substance (15, 94) comprises colorant. The term "caulk" is broadly defined to include various types of caulking fluids. Substantially white caulk (when applied) or substantially clear caulk (when applied) is preferred. The term "colorant" is broadly defined to include paint (including latex paint and oil-based paint), pigment, dye, and mixtures thereof.

In a related embodiment, the first substance (13, 90) comprises low molecular weight polymer (e.g., polyester) and the second substance (15, 94) comprises a curing agent (e.g., amine-acetoacetate), whereby the first substance and the second substance may be mixed to form a sealant.

In a related embodiment, the first substance (13, 90) comprises prepolymer (e.g., diepoxy) and the second substance (15, 94) comprises a curing agent (e.g., diamine), whereby the first substance and the second substance may be mixed to form an epoxy material.

In yet another embodiment, the first substance (13, 90) comprises a nitrile rubber (e.g., a copolymer of acrylonitrile (ACN) and butadiene) and the second substance (15, 94) comprises a phenolic resin, whereby the first substance and the second substance may be mixed to form a cement material.

Although various embodiments of the invention have been described above, other embodiments of the invention include methods, including methods for using the apparatus described above.

A preferred method includes the steps of (1) providing an apparatus including a primary zone and a secondary zone, the primary zone being at least partially filled with a first substance; (2) inserting a second substance into the secondary zone; (3) breaching the secondary chamber such that the first substance and the second substance may exit to a mixing zone; (4) attaching a mixing zone (e.g., dispensing tip 32) to the primary chamber; and (5) forcing at least a portion of the first substance and at least a portion of the second substance into a mixing zone so that the first substance and the second substance are substantially mixed in the mixing zone prior to exiting the mixing zone. The "inserting" step may be accomplished at a number of fill port locations on the particular apparatus used, as demonstrated by the various apparatus embodiments discussed above. The inserting may be accomplished by a graduated syringe with a needle; by a specialized syringe for attaching to, for example, engagement member 26; or any other device known to persons having ordinary skill in the art that is capable of forcing fluid into a chamber. The "breaching" step as described above may be accomplished, for example, by puncturing the lower and upper layer of the secondary chamber as shown in FIG. 1. In an alternative situation in which the secondary chamber is at least partially pre-filled with a second substance, the "breaching" step may include removing a barrier structure such as barrier structure 84 shown in FIG. 13. The "forcing" step preferably includes moving a back plug (e.g., back plug 24) toward a dispensing end of the primary chamber. This "forcing" step is preferably accomplished using a caulking gun or similar apparatus.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An apparatus for mixing two or more fluid substances, the apparatus comprising:

(a) an elongate primary chamber configured for containing a first substance, the primary chamber including a primary chamber dispensing end and a primary chamber non-dispensing end;

(b) an elongate secondary chamber substantially aligned longitudinally with and attached to the primary chamber, the secondary chamber configured for containing a second substance, the secondary chamber including a secondary chamber dispensing end and a secondary chamber non-dispensing end wherein the secondary chamber non-dispensing end is proximate the primary chamber dispensing end;

(c) a movable back plug configured for longitudinal movement along the primary chamber, wherein such longitudinal movement toward the primary chamber dispensing end causes at least a portion of the first substance to exit through the primary chamber dispensing end and at least a portion of the second substance to exit through the primary chamber dispensing end; and (d) a dispensing tip attached to the primary chamber dispensing end, the dispensing tip including a mixing chamber that, when the back plug is moved toward the primary chamber dispensing end, causes substantial mixing of the first substance with the second substance.

2. The apparatus of claim 1 wherein:

(a) the elongate primary chamber further comprises a substantially rigid tube including a substantially cylindrical shape;

(b) the elongate secondary chamber comprises an elongate non-rigid bladder attached to the inner surface of the primary chamber, the non-rigid bladder extending from at least the primary chamber non-dispensing end to substantially the center of the primary chamber dispensing end; and (c) the movable back plug further comprises a substantially rigid plug shaped to substantially fit crosswise within the rigid tube, the rigid plug including an edge surface that is capable of sliding along the secondary chamber such that any contents within the non-rigid bladder are forced toward the primary chamber dispensing end substantially when the back plug is moved toward the primary chamber dispensing end.

3. The movable back plug of claim 2 further comprising a substantially vertical groove located along the edge surface substantially where the back plug contacts the non-rigid bladder.

4. The apparatus of claim 1, further comprising:

(a) a fill port disposed on an outer surface of the primary chamber, the apparatus configured for fluid communication between the fill port and the secondary chamber such that the secondary chamber may be filled with the second substance by insertion of the second substance through the fill port; and (b) a barrier structure configured for substantially obstructing fluid communication between the fill port and the secondary chamber.

5. The apparatus of claim 4 further comprising:

(a) a secondary chamber that extends beyond the non-dispensing end of the primary chamber in a direction away from the dispensing end of the primary chamber;

(b) a fill port located substantially along the secondary chamber non-dispensing end.

6. The apparatus of claim 5 further comprising an upper portion of the second chamber extending from at least as far as two centimeters from the secondary chamber non-dispensing end to about the secondary chamber non-dispending end, wherein the upper portion comprises semi-rigid material.

7. The apparatus of claim 1, wherein the primary chamber dispensing end further comprises:

(a) a fill port in fluid communication with the secondary chamber, such that the secondary chamber may be filled with a second substance by insertion of the second substance through the fill port; and (b) a barrier structure capable of substantially blocking fluid communication between the fill port and the secondary chamber.

8. The apparatus of claim 1 further comprising an engagement member attached to the primary chamber at a location along the primary chamber dispensing end substantially proximate a first aperture, whereby fluid may flow through the first aperture and through the engagement member.

9. The apparatus of claim 8 wherein the dispensing tip further comprises a removable dispensing tip that is removably attachable to the engagement member, the removable dispensing tip including a mixing chamber.

10. The apparatus of claim 9 wherein the mixing chamber further comprises a mesh mixing section.

11. The apparatus of claim 10 wherein the mixing chamber further comprises a substantially helical mixing section.

12. The apparatus of claim 9 wherein the mixing chamber further comprises a plurality of baffles.

13. The apparatus of claim 9 further comprising:

(a) a displaceable primary chamber barrier preventing substantially all fluid communication between the primary chamber and the dispensing tip, wherein at least partial displacement of the primary chamber barrier releases a portion of the first substance allowing such portion of the first substance to flow to the dispensing tip; and (b) a displaceable secondary chamber barrier preventing substantially all fluid communication between the secondary chamber and the dispensing tip, wherein at least partial displacement of the secondary chamber barrier releases a portion of the second substance allowing such portion of the second substance to flow to the dispensing tip.

14. The apparatus of claim 13 wherein the primary chamber barrier and the secondary chamber barrier comprise the same displaceable barrier.

15. The apparatus of claim 9 comprising a configuration such that a portion of the secondary chamber is disposed proximate to a first aperture located along the primary chamber dispensing end, obstructing fluid communication between the primary chamber and the dispensing tip.

16. The apparatus of claim 1 wherein:

(a) the primary chamber further comprises a substantially cylindrical tube at least partially filled with a first substance, wherein the first substance comprises caulk;

(b) the secondary chamber further comprises a substantially non-rigid bladder at least partially filled with the second substance, wherein the second substance comprises colorant.

17. The apparatus of claim 1 wherein:

(a) the primary chamber further comprises a substantially cylindrical tube at least partially filled with the first substance, wherein the first substance comprises a low molecular weight polymer; and (b) the secondary chamber further comprises a bladder at least partially filled with a second substance, wherein the second substance comprises a curing agent.

18. The apparatus of claim 1 wherein:

(a) the primary chamber further comprises a substantially cylindrical tube at least partially filled with the first substance, wherein the first substance comprises a prepolymer; and (b) the secondary chamber further comprises a bladder at least partially filled with a second substance, wherein the second substance comprises a curing agent.

19. The apparatus of claim 1 wherein:

(a) the primary chamber further comprises a substantially cylindrical tube at least partially filled with a first substance, wherein the first substance comprises a nitrile rubber; and (b) the secondary chamber further comprises a bladder at least partially filled with a second substance, wherein the second substance comprises a phenolic resin.

20. An apparatus for mixing two or more fluid substances, the apparatus comprising:

(a) an elongate primary chamber including a tube, the tube containing a first substance, the primary chamber including a primary chamber dispensing end and a primary chamber non-dispensing end;

(b) an elongate secondary chamber substantially aligned with and attached to the primary chamber, the secondary chamber including a non-rigid bladder configured for containing a second substance, the secondary chamber including a secondary chamber dispensing end and a secondary chamber non-dispensing end;

(c) a back plug configured for longitudinal movement along the primary chamber, wherein such longitudinal movement toward the primary chamber dispensing end displaces at least a portion of the first substance out of the primary chamber and at least a portion of a second substance out of the primary chamber;

(d) an engagement member attached to the primary chamber at a location along the dispensing end of the primary chamber;

(e) a dispensing tip removably attachable to the engagement member, the dispensing tip including a mixing chamber that, substantially when the back plug is moved toward the primary chamber dispensing end, causes substantial mixing of the first substance from the primary chamber with a second substance from the secondary chamber;

(f) a fill port located along the outer surface of the primary chamber, the fill port configured for fluid communication through the fill port to the secondary chamber such that the secondary chamber may be filled with a second substance by insertion of a second substance through the fill port; and (g) a barrier structure configured for substantially obstructing fluid communication between the fill port and the secondary chamber.

21. A method for mixing a first substance with a second substance using the apparatus defined in claim 20, the method comprising the steps of:

(a) inserting a second substance into the secondary chamber;

(b) breaching the apparatus proximate the engagement member, whereby the first substance from the primary chamber and the second substance from the secondary chamber may exit the primary chamber;

(c) attaching the dispensing tip to the engagement member; and (d) forcing the first substance and the second substance into the dispensing tip.

22. The method of claim 21 wherein step (d) further comprises using a caulking gun to force the back plug toward the primary chamber dispensing end.

23. A method for mixing at least two fluid substances to form a mixture, the method comprising the steps of:

(a) providing a mixing apparatus comprising:

(i) an elongate primary fluid storage zone having been pre-filled with a first substance;

(ii) an elongate secondary fluid storage zone longitudinally aligned with the primary fluid storage zone for storing a second substance;

(iii) a mixing zone; and (iv) a separation barrier obstructing the first substance and the second substance from entering the mixing zone;

(b) inserting a second substance into the secondary fluid storage zone;

(c) breaching the separation barrier; and (d) forcing the first substance and the second substance, substantially simultaneously, to the mixing zone.

* * * * *